US009452881B2

(12) United States Patent
Skeid et al.

(10) Patent No.: US 9,452,881 B2
(45) Date of Patent: Sep. 27, 2016

(54) CARGO LOCKER WITH DOORS

(71) Applicants: Eirik Smedsrud Skeid, Fornebu (NO); Jonas Dovik, Oslo (NO)

(72) Inventors: Eirik Smedsrud Skeid, Fornebu (NO); Jonas Dovik, Oslo (NO)

(73) Assignee: Mobile Shelter Systems AS, Fornebu (NO)

( * ) Notice: Subject to any disclaimer, the term of this patent is extended or adjusted under 35 U.S.C. 154(b) by 151 days.

(21) Appl. No.: 14/543,686

(22) Filed: Nov. 17, 2014

(65) Prior Publication Data

US 2016/0137407 A1 May 19, 2016

(51) Int. Cl.

*B65D 88/12* (2006.01)
*B65D 90/00* (2006.01)
*B65D 19/10* (2006.01)

(52) U.S. Cl.

CPC ..... *B65D 90/008* (2013.01); *B65D 19/10* (2013.01); *B65D 88/12* (2013.01); *B65D 2519/00024* (2013.01); *B65D 2519/00059* (2013.01); *B65D 2519/00094* (2013.01); *B65D 2519/0097* (2013.01); *B65D 2519/00164* (2013.01); *B65D 2519/00199* (2013.01); *B65D 2519/00233* (2013.01); *B65D 2519/00273* (2013.01); *B65D 2519/00288* (2013.01); *B65D 2519/00293* (2013.01); *B65D 2519/00323* (2013.01); *B65D 2519/00333* (2013.01); *B65D 2519/00373* (2013.01); *B65D 2519/00502* (2013.01); *B65D 2519/00512* (2013.01); *B65D 2519/00562* (2013.01); *B65D 2519/00626* (2013.01); *B65D 2519/00666* (2013.01); *B65D 2519/00701* (2013.01); *B65D 2519/00716* (2013.01)

(58) Field of Classification Search

CPC .. B65D 90/008; B65D 19/10; B65D 19/385; B65D 88/12; Y10S 292/68
USPC ..... 292/32, 33, 42, 37, 163, 175; 220/1.5; 206/386
See application file for complete search history.

(56) References Cited

U.S. PATENT DOCUMENTS

| | | | | |
|---|---|---|---|---|
| 1,964,114 | A * | 6/1934 | Gerlach | D06F 37/10 220/326 |
| 2,928,540 | A | 3/1960 | Cunningham | |
| 3,322,286 | A | 5/1967 | Sylvester | |
| 3,407,926 | A | 10/1968 | Rosser | |
| 3,547,258 | A | 12/1970 | Black | |
| 3,812,974 | A | 5/1974 | Sylvester | |
| 3,841,516 | A * | 10/1974 | Marz | B65D 90/008 16/386 |
| 3,850,295 | A | 11/1974 | Black | |
| 3,915,303 | A | 10/1975 | Tatham | |
| 3,987,915 | A | 10/1976 | Conner | |
| 4,290,370 | A | 9/1981 | Gallagher | |
| 4,295,431 | A | 10/1981 | Stavlo | |
| 4,714,169 | A | 12/1987 | Keenan | |
| 5,378,106 | A | 1/1995 | Risley | |
| 5,626,241 | A | 5/1997 | Holden | |
| 5,671,850 | A | 9/1997 | Basala | |
| 6,044,990 | A | 4/2000 | Palmeri | |
| 6,164,476 | A | 12/2000 | Rene | |
| 6,273,670 | B1 | 8/2001 | Henson | |
| 6,298,999 | B1 | 10/2001 | Bellman | |
| 6,422,405 | B1 | 7/2002 | Haenszel | |
| 6,637,077 | B2 | 10/2003 | Doty | |
| RE39,444 | E | 12/2006 | Rene | |
| 7,866,501 | B2 * | 1/2011 | Schutz | B65D 19/10 206/386 |
| 2006/0156694 | A1 | 7/2006 | Aubin | |
| 2006/0214446 | A1 | 9/2006 | Johns | |
| 2009/0148260 | A1 | 6/2009 | Leimbach | |
| 2012/0152946 | A1 * | 6/2012 | Gronholm | B65D 19/10 220/6 |
| 2014/0231422 | A1 * | 8/2014 | Kochanowski | B65D 90/008 220/1.5 |

* cited by examiner

*Primary Examiner* — Stephen Castellano
(74) *Attorney, Agent, or Firm* — Michael A. Blake

(57) ABSTRACT

A cargo transportation locker, the locker comprising: a floor; a first corner post in communication with the floor; a second corner post in communication with the floor; a third corner post in communication with the floor; a fourth corner post in communication with the floor; a first door in rotatable communication with the first corner post, the first door comprising: a first angled door member located in an upper corner of the first door adjacent the first post, where the first angled door member makes an angle with the top side of the first door of less than 90°, and makes an angle of less than 90° with the hinged side of the first door; a second angled door member located in a lower corner of the first door adjacent the first post, where the first angled door member makes an angle with the bottom side of the first door of less than 90°, and makes an angle of less than 90° with the hinged side of the first door; a second door in rotatable communication with the second corner post; the second door comprising: a third angled door member located in an upper corner of the second door adjacent the second post, where the third angled door member makes an angle with the top side of the second door of less than 90°, and makes an angle of less than 90° with the hinged side of the second door; a fourth angled door member located in a lower corner of the second door adjacent the second post, where the fourth angled door member makes an angle with the bottom side of the second door of less than 90°, and makes an angle of less than 90° with the hinged side of the second door. A cargo transportation locker, the locker comprising: a floor; a first corner post in communication with the floor; a second corner post in communication with the floor; a third corner post in communication with the floor; a fourth corner post in communication with the floor; a first door in rotatable communication with the first corner post, the first door comprising: a first angled door member located in an upper corner of the first door adjacent the first post, where the first angled door member makes an angle with the top side of the first door of less than 90°, and makes an angle of less than 90° with the hinged side of the first door; a second angled door member located in a lower corner of the first door adjacent the first post, where the first angled door member makes an angle with the bottom side of the first door of less than 90°, and makes an angle of less than 90° with the hinged side of the first door; a first door handle; the first door handle comprising: a slideable member configured to slide from the first door to the second door, and when slid into the second door, the first and second doors are locked in a closed orientation; a first slideable member hole, located in the slideable member, and when first slideable member hole is padlocked, the first and second doors are locked in a closed orientation; a second slideable member hole, located in the slideable member, and when second slideable member hole is padlocked, the slideable member does not restrict the second door from opening and closing. a second door in rotatable communication with the second corner post; the second door comprising: a third angled door member located in an upper corner of the second door adjacent the second post, where the third angled door member makes an angle with the top side of the second door of less than 90°, and makes an angle of less than 90° with the hinged side of the second door; a fourth angled door member located in a lower corner of the second door adjacent the second post, where the fourth angled door member makes an angle with the bottom side of the second door of less than 90°, and makes an angle of less than 90° with the hinged side of the second door; a second door handle, the second door handle comprising: an upper spring loaded sliding member; at least one spring in communication with the supper spring loaded sliding member; a lower spring loaded sliding member in communication with the at least one spring; an upper locking rod in communication with the upper spring loaded member; a lower locking rod in communication with the lower spring loaded member; a first top support member in communication with the first corner post and the second corner post, the first top support member having a upper rod hole in its underside; a first floor support member located beneath the floor and in communication with the first corner post and second corner post, the first floor support member having a lower rod hole in its upper side; and where when the upper spring loaded sliding member and lower spring loaded sliding member are fully spread apart, the upper locking rod extends through the upper rod hole, and the lower locking rod extends through the lower rod hole thereby locking the second door to the locker, and when the upper spring loaded sliding member and lower spring loaded sliding member are squeezed together, the upper locking rod retracts from the upper rod hole and the lower locking rod retracts from the lower rod hole, thereby unlocking the second door from the locker.

8 Claims, 11 Drawing Sheets

CARGO LOCKER WITH DOORS

TECHNICAL FIELD

The invention relates to lockers, and more particularly, to cargo transportation lockers.

BACKGROUND

There are known lockers used in the transportation industry. Many of these lockers have disadvantages. One disadvantage is that the known lockers may have hinged doors that swing open and closed. The hinges on these doors are often damaged when moving cargo around the lockers, or when moving the lockers themselves. Another drawback is that structural shape of the lockers may tend to deform under large weight loads, or during movement, or stacking of the lockers.

Thus there is a need for lockers that overcome the above listed and other disadvantages.

SUMMARY OF THE INVENTION

The invention relates to a cargo transportation locker, the locker comprising: a floor; a first corner post in communication with the floor; a second corner post in communication with the floor; a third corner post in communication with the floor; a fourth corner post in communication with the floor; a first door in rotatable communication with the first corner post, the first door comprising: a first angled door member located in an upper corner of the first door adjacent the first post, where the first angled door member makes an angle with the top side of the first door of less than 90°, and makes an angle of less than 90° with the hinged side of the first door; a second angled door member located in a lower corner of the first door adjacent the first post, where the first angled door member makes an angle with the bottom side of the first door of less than 90°, and makes an angle of less than 90° with the hinged side of the first door; a second door in rotatable communication with the second corner post; the second door comprising: a third angled door member located in an upper corner of the second door adjacent the second post, where the third angled door member makes an angle with the top side of the second door of less than 90°, and makes an angle of less than 90° with the hinged side of the second door; a fourth angled door member located in a lower corner of the second door adjacent the second post, where the fourth angled door member makes an angle with the bottom side of the second door of less than 90°, and makes an angle of less than 90° with the hinged side of the second door.

The invention also relates to a cargo transportation locker, the locker comprising: a floor; a first corner post in communication with the floor; a second corner post in communication with the floor; a third corner post in communication with the floor; a fourth corner post in communication with the floor; a first door in rotatable communication with the first corner post, the first door comprising: a first door handle; the first door handle comprising: a slideable member configured to slide from the first door to the second door, and when slid into the second door, the first and second doors are locked in a closed orientation; a first slideable member hole, located in the slideable member, and when first slideable member hole is padlocked, the first and second doors are locked in a closed orientation; a second slideable member hole, located in the slideable member, and when second slideable member hole is padlocked, the slideable member does not restrict the second door from opening and closing. a second door in rotatable communication with the second corner post; the second door comprising: a second door handle, the second door handle comprising: an upper spring loaded sliding member; at least one spring in communication with the supper spring loaded sliding member; a lower spring loaded sliding member in communication with the at least one spring; an upper locking rod in communication with the upper spring loaded member; a lower locking rod in communication with the lower spring loaded member; a first top support member in communication with the first corner post and the second corner post, the first top support member having a upper rod hole in its underside; a first floor support member located beneath the floor and in communication with the first corner post and second corner post, the first floor support member having a lower rod hole in its upper side; and where when the upper spring loaded sliding member and lower spring loaded sliding member are fully spread apart, the upper locking rod extends through the upper rod hole, and the lower locking rod extends through the lower rod hole thereby locking the second door to the locker, and when the upper spring loaded sliding member and lower spring loaded sliding member are squeezed together, the upper locking rod retracts from the upper rod hole and the lower locking rod retracts from the lower rod hole, thereby unlocking the second door from the locker.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
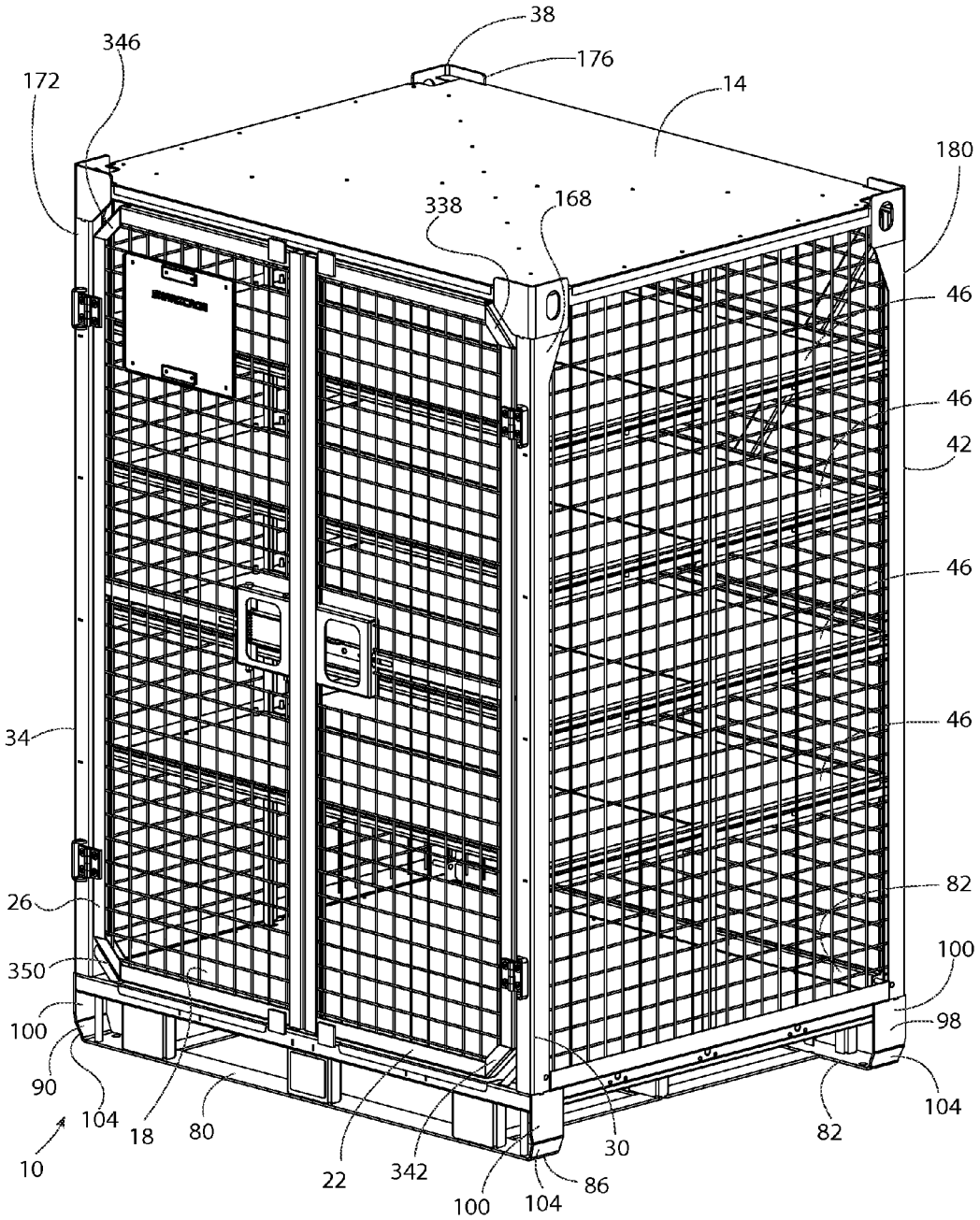
FIG. 1 is a perspective view of the locker.

FIG. 1 is a perspective view of one embodiment of the transportable locker 10. The locker comprises a top 14, a floor 18, a first door 22, and a second door 26. The locker 10 may have a first corner 30, a second corner 34, a third corner 38, and a fourth corner 42. The locker may comprise a first corner post 168, a second corner post 172, a third corner post 176, and a fourth corner post 180. In addition, in some embodiments, the locker 10 may have one or more shelves 46. The locker 10 may also comprise a first bottom rail 80 and a second bottom rail 82. The bottom rails 80, 82 may be located below the floor 18. The bottom rail 80 is attached to the locker 10 by a first angled member 86, and second angled member 90. Similarly the second bottom rail 82, is attached to the locker by a third angled member 94 (not visible in this view), and a fourth angled member 98. The angled members 86, 90, 94, 98 each have a generally vertical portion 100, and an angled portion 104 that is at an angle with respect to the vertical portion 100, located generally below the vertical portion 100. The angled members 86, 90, 94, 98 are generally self-centering members that help self-center the locker 10 when stacking the lockers on top of one another.

Figure 2:
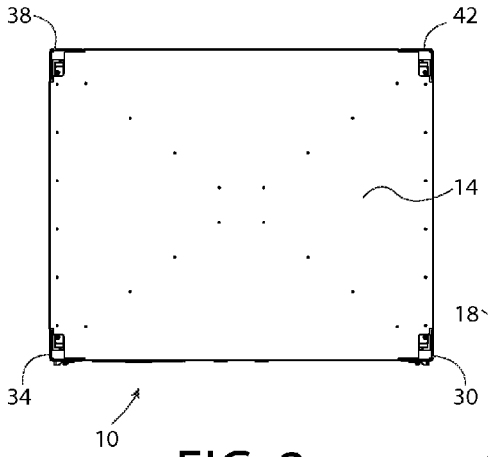
FIG. 2 is a top view of the locker.
Figure 3:
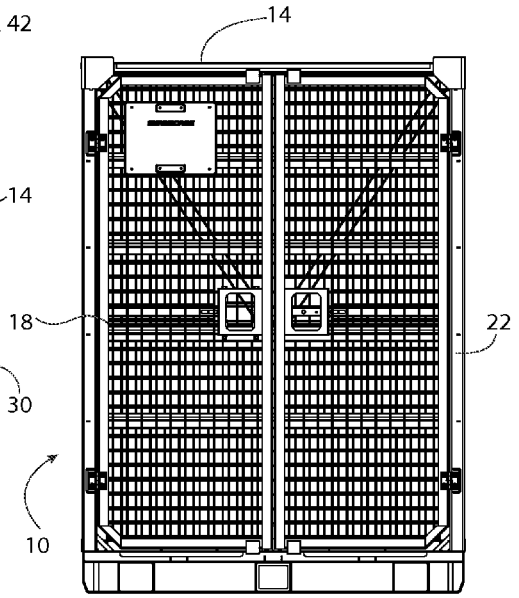
FIG. 3 is a front view of the locker.
Figure 4:
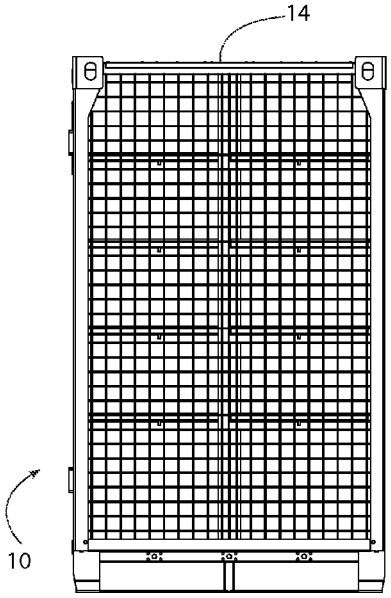
FIG. 4 is a side view of the locker.
Figure 5:
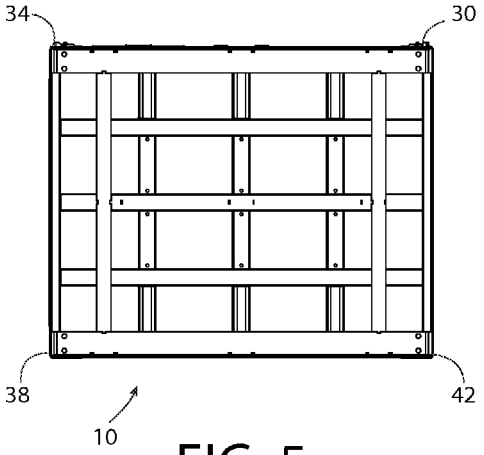
FIG. 5 is a bottom view of the locker.

FIG. 2 is a top view of the transportable locker 10 from FIG. 1. FIG. 3 is a front view of the transportable locker 10 from FIG. 1. FIG. 4 is a side view of the transportable locker 10 from FIG. 1. FIG. 5 is a bottom view of the transportable locker 10 from FIG. 1.

Figure 6:
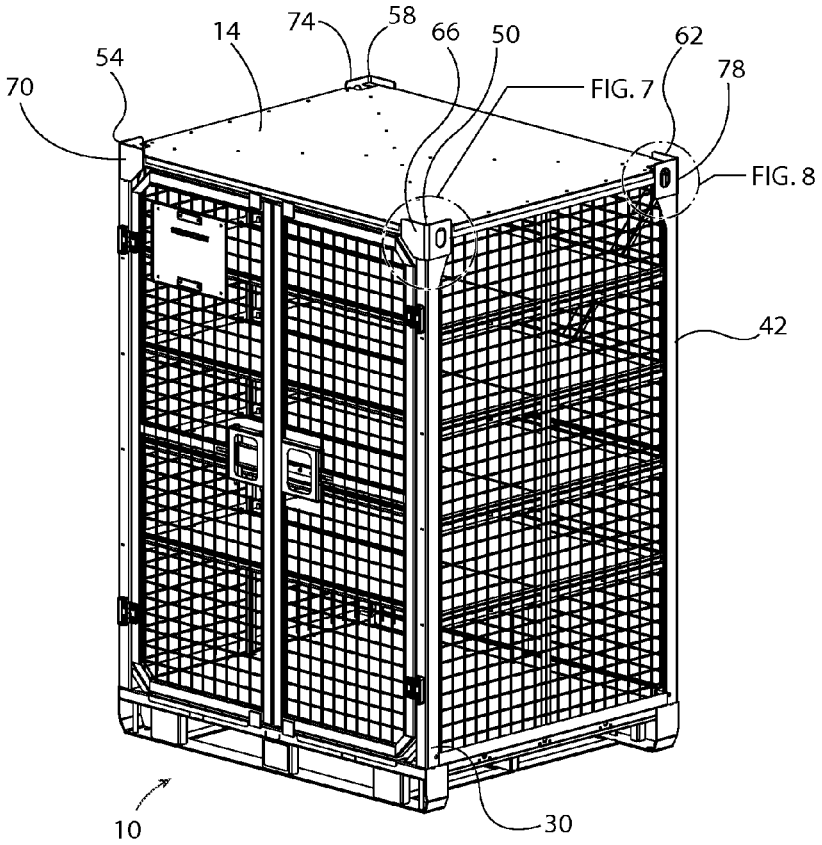
FIG. 6 is a perspective view of the locker.
Figure 7:
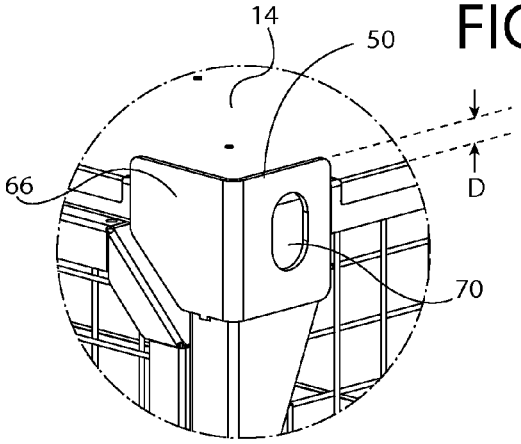
FIG. 7 is a detail view of a top corner of the locker.
Figure 8:
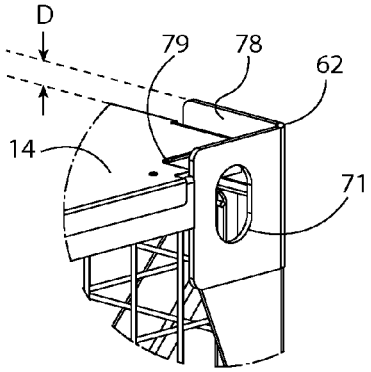
FIG. 8 is a detail view of another top corner of the locker.

FIG. 6 shows a perspective view of the locker 10. Top corner 50 is shown in more detail in FIG. 7. Top corner 62 is shown in more detail in FIG. 8. The locker has a first angled bracket 66, second angled bracket 70, third angled bracket 74, and fourth angled bracket 78 located at the four corners 50, 54, 58, 62 respectively. FIG. 7 shows an angled bracket 66 located at the top corner 50. The angled bracket 66 is attached to the locker 10 at the top corner and provides strength to the locker 10 that will generally prevent the locker's structural shape from deforming under loads up to a threshold load. The angled bracket 66 extends slightly above the top 14 of the locker 10 by a distance D. The angled bracket 66 may have an aperture 70. The aperture 70 is configured to allow a chain or strap to go through it, so that a crane or other device can lift the locker 10. FIG. 8 shows a second angled bracket 74 at the top corner 62. The second angled bracket 74 is attached to the locker 10 at the top corner 62 and provides strength to the locker 10 that will generally prevent the locker's structural shape from deforming under loads up to a threshold load. The angled bracket 74 extends slightly above the top 14 of the locker 10 by a distance D. The angled bracket 66 may have an aperture 70. Please note that there is a small cutout 79 in the top near the bracket 74. This allows a chain or strap to go through the aperture 71 of the bracket 74 without being blocked by the top 14. There is also a similar cutout adjacent to angled bracket 66, but is not visible in the view of FIG. 7.

Figure 9:
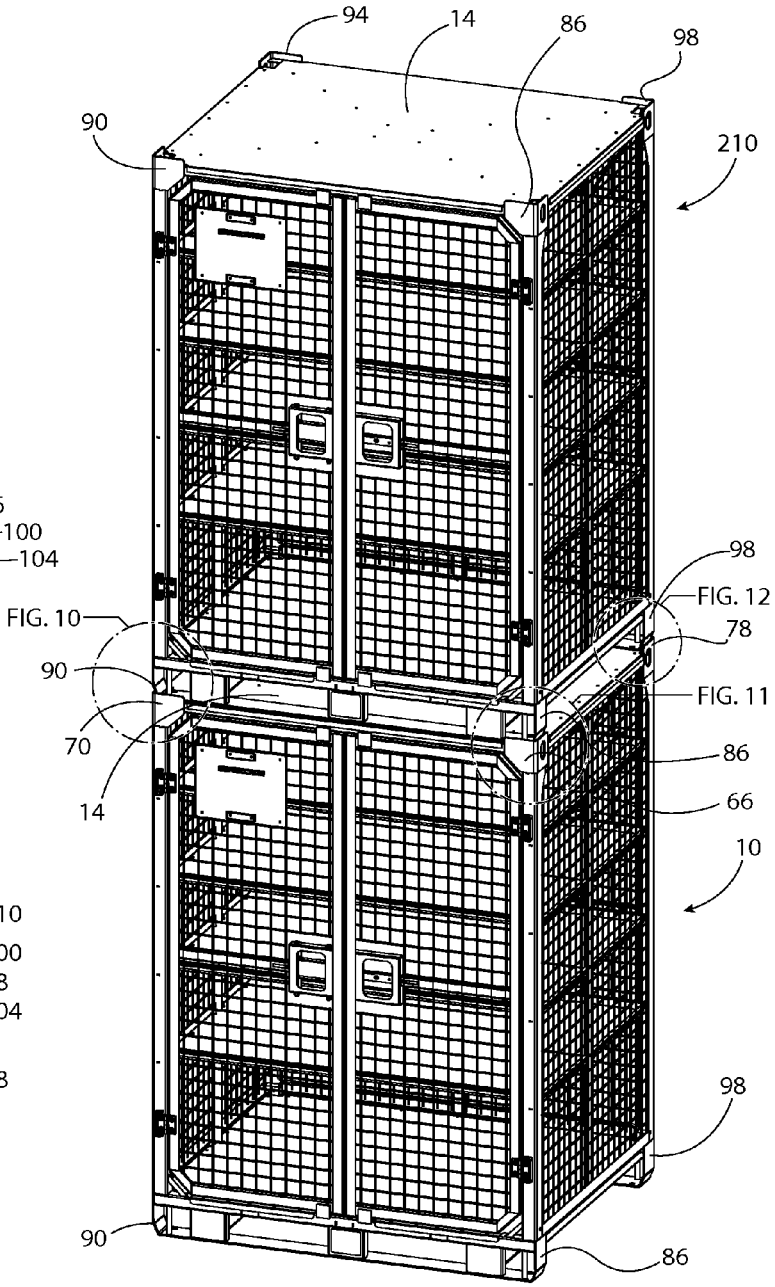
FIG. 9 is a perspective view of two stacked lockers.

FIG. 9 shows two lockers stacked on top of another. The bottom locker is 10, the top locker is 210. One can see how the angled brackets 66, 70, 74, 78 of the bottom locker 10 hold the angled members 86, 90, 94, 98 of the top locker 210. Because the angled brackets 66, 70, 74, 78 extend over the top 14 of the locker 10, they form a partial housing to hold the angled members brackets 86, 90, 94, 98 of the top locker 210.

Figure 10:
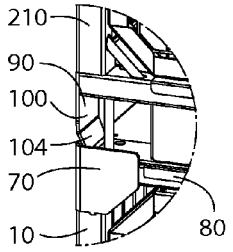
FIG. 10 is a detail view of a top corner of the bottom locker from FIG. 9.
Figure 11:
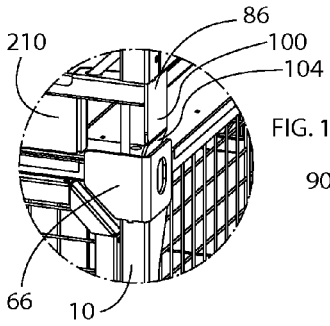
FIG. 11 is a detail view of another top corner of the bottom locker from FIG. 9.
Figure 12:
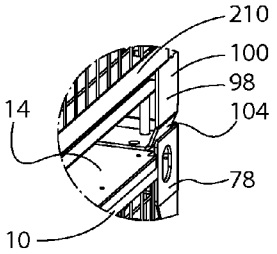
FIG. 12 is a detail view of another top corner of the bottom locker from FIG. 9.

FIG. 10 is a close up view of a portion of the stacked lockers 10, 210. FIG. 11 is a close up view of another portion of the stacked locker 10, 210. FIG. 12 is a close up view of another portion of the stacked locker 10, 210.

Figure 13:
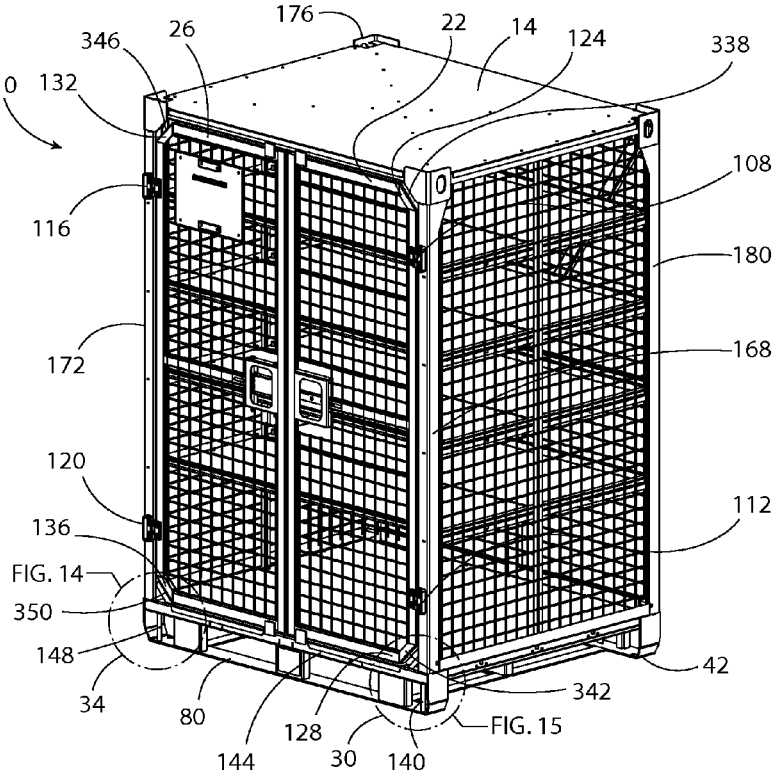
FIG. 13 is a perspective view of the locker.
Figure 14:
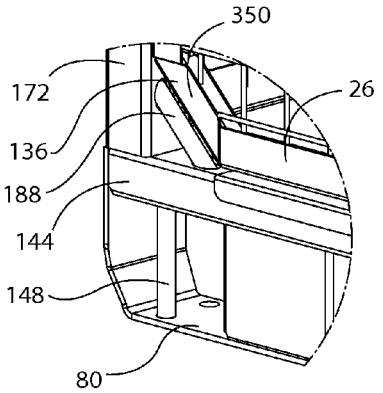
FIG. 14 is a detail view of a bottom corner of the locker.
Figure 15:
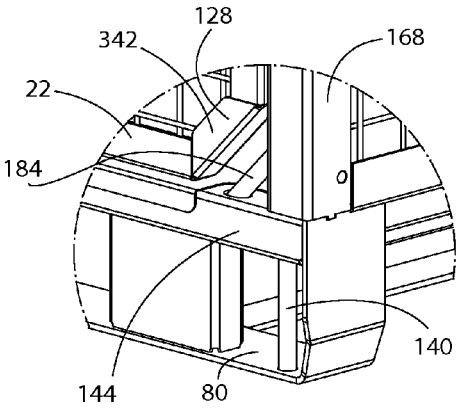
FIG. 15 is a detail view of another bottom corner of the locker.

FIG. 13 is another perspective view of the locker 10. FIG. 14 is a close up view of the bottom second corner 34 of the locker 10. FIG. 15 is a close up view of the bottom first corner 30 of the locker. The first door 22 is attached to the locker 10 via a first hinge 108, and second hinge 112. The second door 26 is attached to the locker 10 via a third hinge 116, and fourth hinge 120. First door 22 has a first inner corner 124, and a second inner corner 128. Second door 26 has a third inner corner 132, and a fourth inner corner 136. Note how the first door at inner corners 124, 128 do not form a 90° angle, but rather are angled with an angled door members 338, 342. Angled door member 338 makes a first angle of less than 90° with the top of the first door 22, and angled door member 338 makes a second angle of less than 90° with the hinged side of the first door 22. The first and second angles, may in one embodiment, be about 45°. The angled door member 342 also makes similar angles with the hinged side and bottom side of the first door. Similarly, note how the second door at inner corners 132, 136 do not form a 90° angle, but rather are angled with an angled door members 346, 350. The angled door member 346, 350 also makes similar angles, as angled door member 338, with the top side and hinged side of the second door, and the hinged side and bottom side of the second door, respectively. Because of this angled shape at these corners, the locker can be reinforced with brackets 278, 274, without the brackets getting into the way of the door at the corner (since there is not a 90° corner). Also, at the lower corner of the doors, first internal strapping member 184 and second internal strapping member 188 can reinforce the corners. Also note how there is a first strapping member 140 adjacent to the second inner corner 128 and attached to a first floor support member 144 and the bottom rail 80. There is a second strapping member 148 adjacent to the second inner corner 136 and attached to a first floor support member 144 and bottom rail 80. There are also a third and fourth strapping member 152, 156 located at the bottom third corner 38, and bottom fourth corner 42, but those strapping members 152, 156 are not visible in this view. Those strapping members 152, 156 are attached to a second floor support 160 (not visible in this view) and a second bottom rail 82 (not visible in this view). Strapping members 140, 148, 152, 156 are external strapping members, and may be used to strap the locker 10 to the ground or floor. A first internal strapping member 184 is attached to the first corner post 168 and the first floor support member 144. A second internal strapping member 188 is attached to the second corner post 172 and the first floor support member 144. The internal strapping members 184, 188 also provide rigidity to the locker 10.

Figure 16:
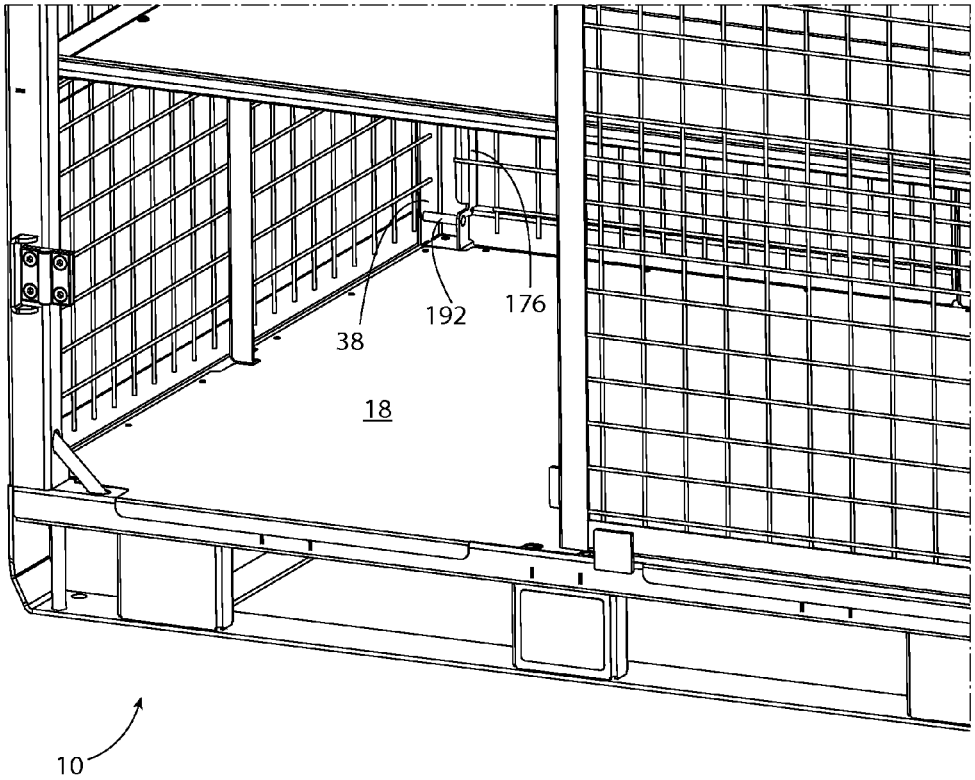
FIG. 16 is a detail view of another bottom corner of the locker.

FIG. 16 is a view of the bottom third corner 38 of the locker 10. The second door 26 has been removed in this view. A third internal strapping member 192 is shown attached to two walls that comprise the third post 176. Similarly, a fourth internal strapping member 196 is attached to two walls that comprise the fourth post 180, but is not visible in this view. All of the internal strapping members 184, 188, 192, 196 are located above the floor, and may be used to strap goods down inside the locker 10.

Figure 18:
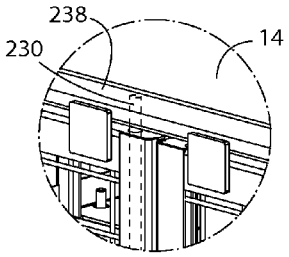
FIG. 18 is a detail view of top of the first and second doors.
Figure 19:
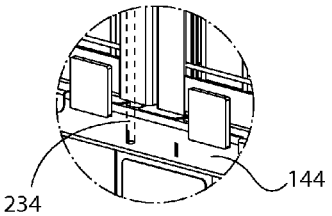
FIG. 19 is a detail view of the bottom of the first and second doors.
Figure 20:
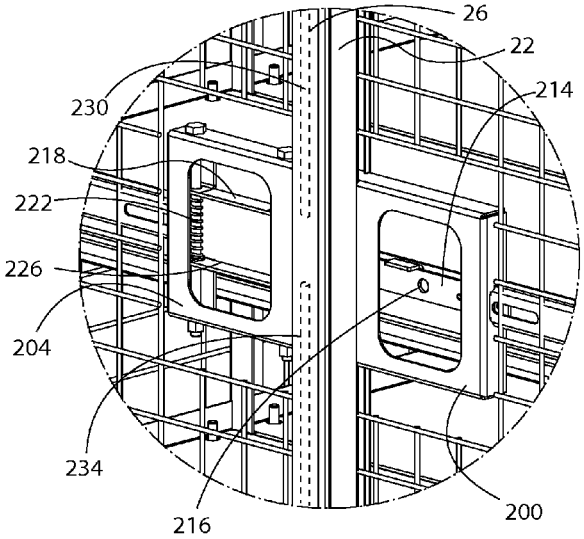
FIG. 20 is a detail view of the door handles.
Figure 17:
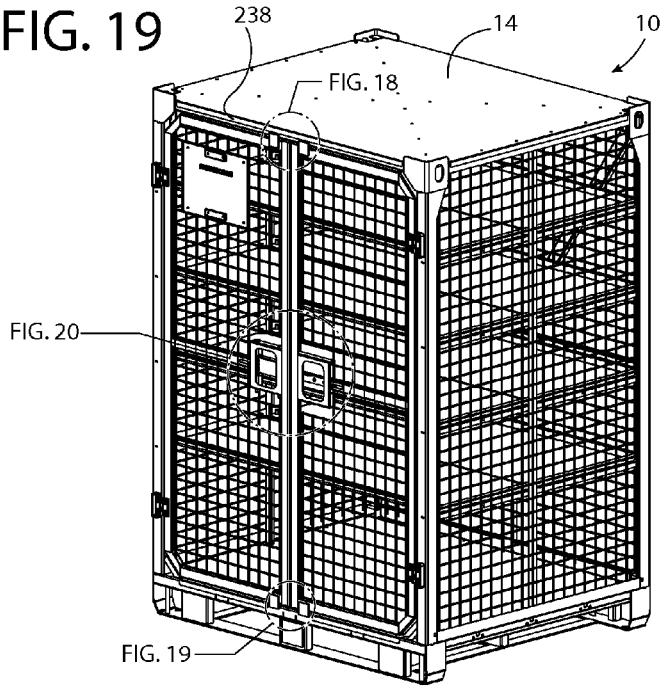
FIG. 17 is a perspective view of the locker.

FIG. 17 is a perspective view of the locker 10. FIG. 18 is a detail view of the tops of the doors 22, 26; FIG. 19 is a detail view of the bottoms of the doors 22, 26, and FIG. 20 is a detail view of the first door handle 200, and second door handle 204. The first door handle 200 comprises a slideable member 214, that can slide across from the first door 22 to the second door 26. When the slideable member 214 is slid across (to the left in FIG. 20) to the second door 26, the slideable member locks the second door 26 closed with respect to the first door 22. The slideable member 214 has one more locking holes 216, such that the slideable member can be locked, with a padlock for instance, in a locked orientation, with doors 22, 26 locked with respect to each, or can be locked in a second orientation with the slidable member 214 slid all the way to the right, so that the second door 26 can open with respect to the first door 22. The second door handle 204 comprises an upper spring loaded sliding member 218, at least one spring 222, and a lower spring loaded sliding member 226. The upper spring loaded sliding member 218 is in communication with an upper locking rod 230. the upper locking rod 230 is in slideable communication with the second door 26. The lower spring loaded sliding member 226 is in communication with a lower locking rod 234. The lower locking rod 234 is in slideable communication with the door 26. When the upper spring loaded sliding member 218 and lower spring loaded sliding member 226 are fully spread apart by the spring 222, the upper locking rod 230 extends through a hole in the first top support member 238, and the lower locking rod 234 extends through a hole in the first floor support member 144. When the rods 230, 234 extend through the holes in the first top support member 238, and the first floor support member 144, the second door 26 locked closed with respect to the locker 10 and cannot be opened until the rods no longer extend through the holes in the first top support member 238, and the first floor support member 144. The rods are shown in dashed lines because they are behind the door 26. When the upper spring loaded sliding member 218 and lower spring loaded sliding member 226 are squeezed together against the force of the spring 222, the rods 230, 234 retract with respect to the holes in the first top support member 238, and the first floor support member 144, and the door 26 can be opened. FIG. 18 shows how the upper locking rod 230 extends into the first top support member 238. FIG. 19 shows how the lower locking rod 234 extends into the floor support member 144.

Figure 21:
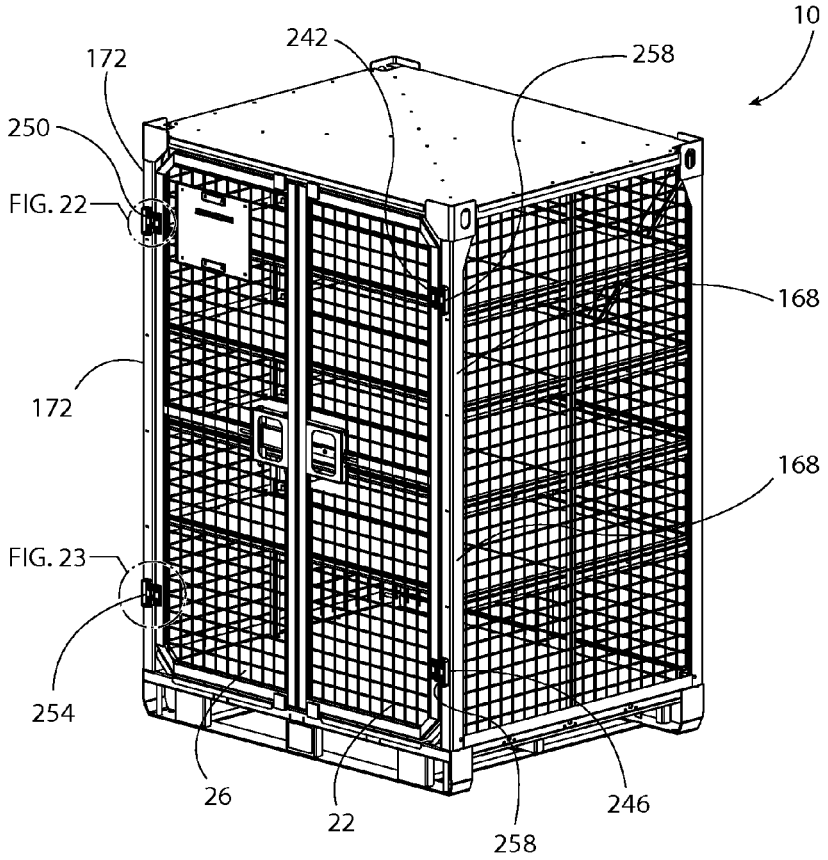
FIG. 21 is a perspective view of the locker.
Figure 22:
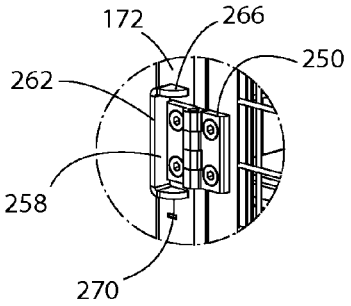
FIG. 22 is a detail view of one hinge.
Figure 23:
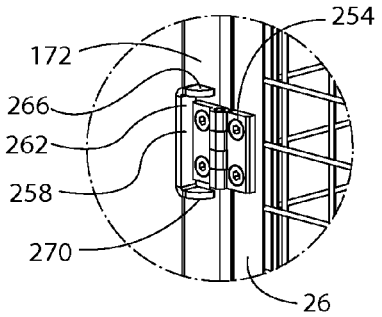
FIG. 23 is a detail view of another hinge.

FIG. 21 is a perspective view of the locker 10. The first door 22 has a first hinge 242, and a second hinge 246. The second door 26 has a third hinge 250 and a fourth hinge 254. FIG. 22 is a detail view of the third hinge 250. FIG. 23 is a detail view of the fourth hinge 254. As can be seen in FIGS. 21-23, each of the hinges are protected by a hinge protection member 258. With respect to the third hinge 250 and fourth hinge 254, the hinge protection members 258 extend out from the second corner post 172 and are located adjacent to the hinges 250, 254. Each hinge protection member 258 comprises a main wall 262 that is longer than the height of each hinge, and a first side wall 266 extends from the top of the main wall, and a second side wall 270 extends from the bottom of the main wall. Each of the walls 262, 266, 270 generally extend orthogonally from the second corner post 172. The hinge protection members 258 prevents various things from bumping into hinges and thereby prevents damage to the hinges. The hinge protection members 258 also act as door stoppers, to stop the amount the doors 22, 26 open. Without the door stopping capability of the hinge protection members 258, the doors could open more than 180°, and could thus break the hinges. There are also hinge protection members extending from the first corner post 168 and are configured to protect the first hinge 242 and second hinge 246.

Figure 24:
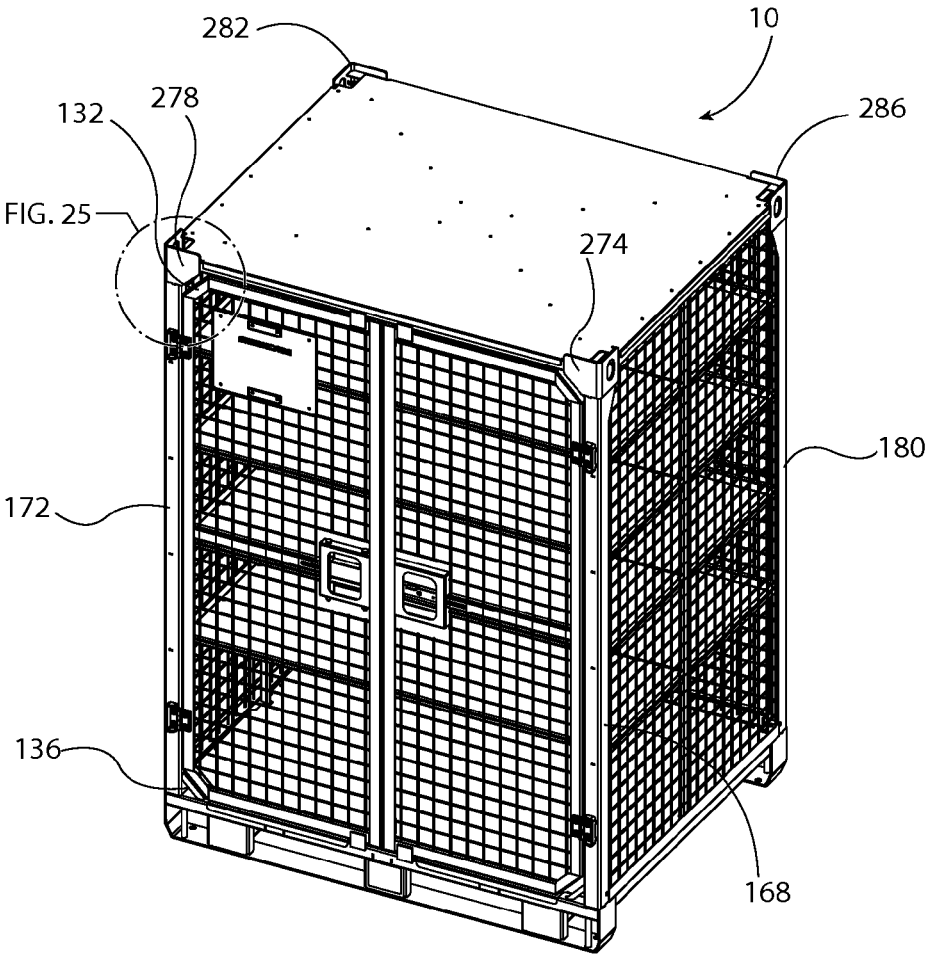
FIG. 24 is a perspective view of the locker.
Figure 25:
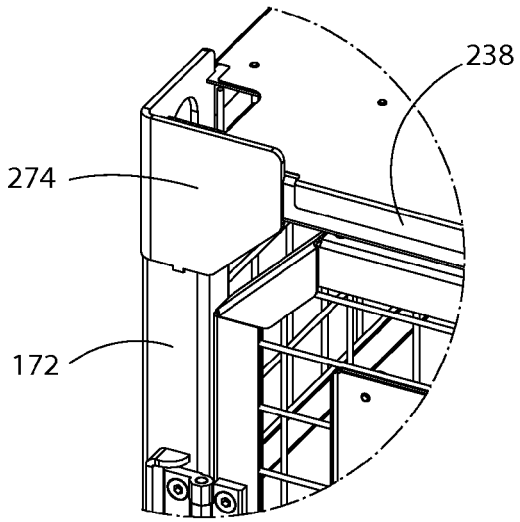
FIG. 25 is a detail view of a top corner of the locker.

FIG. 24 is a perspective view of the locker 10. FIG. 25 is a detail view of the third inner corner 132 of the second door 26. FIG. 24 shows a first corner bracket 274, second corner bracket 278, third corner bracket 282, and a fourth corner bracket 286. FIG. 25 shows the second corner bracket 278 attached to the second corner post 172 and the first top support member 238. The first corner bracket is similarly attached to the first top support member 238 and the first corner post 168. The third corner bracket 282 is similarly attached to the second top support member 290 (not visible in this view) and the third corner post 176 (not visible in this view). The fourth corner bracket 286 is similarly attached to the fourth corner post 180 and the second top support member 290. The corner brackets 274, 278, 282, 286 provide strength to the locker 10 making the locker 10 more rigid.

Figure 26:
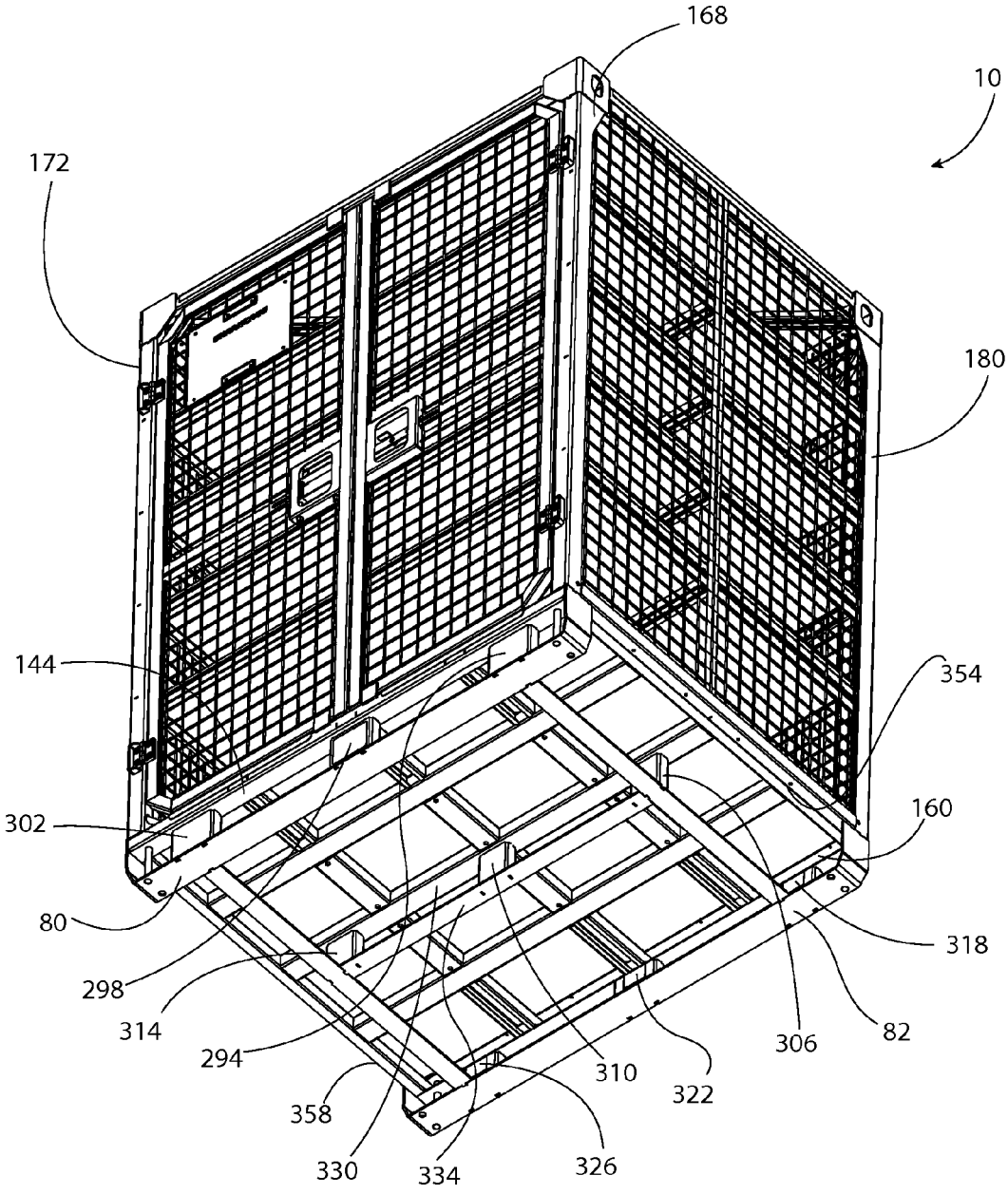
FIG. 26 is a bottom perspective view of the locker.

FIG. 26 shows a perspective view of the underside of a locker 10. In this view the fork lift guides 294, 298, 302, 306, 310, 314, 318, 322, 326 are shown on the underside of the locker. Fork lift guides 294, 298, 302 are attached to the first floor support member 144 and the first bottom rail 80. Fork lift guides 306, 310, 314 are attached to a third first floor support member 330 and a third bottom rail 334. The third first floor support member 330 is attached to a first side member 354 attached to the first corner post 164 and fourth corner post 180, and to a second side member 358 attached to the second corner post 172 and third corner post 176. Fork lift guides 318, 322, 326 are attached to the second floor support member 160 and the second bottom rail 82. The fork lift guides 294, 298, 302, 306, 310, 314, 318, 322, 326 are orientated such that there are two fork lift openings in the front bottom of the locker, rear bottom of the locker 10, first side bottom of the locker, and second side bottom of the locker. Thus, a fork lift can lift the locker from the front, rear, or either of the two sides.

Figure 27:
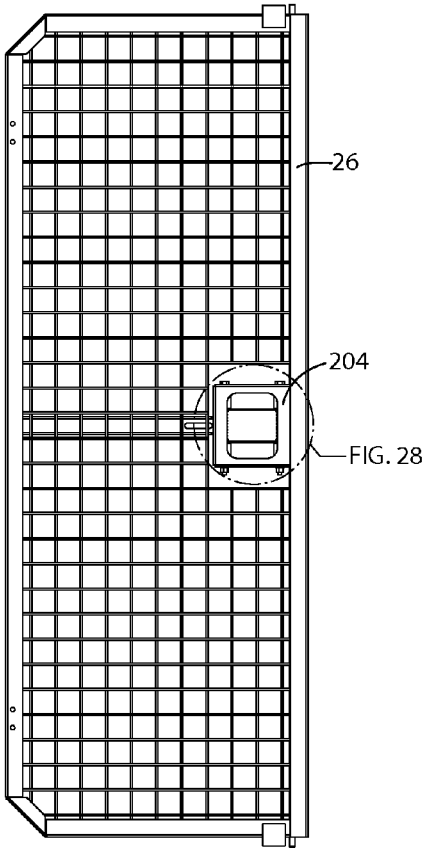
FIG. 27 is a front view of the second door.
Figure 29:
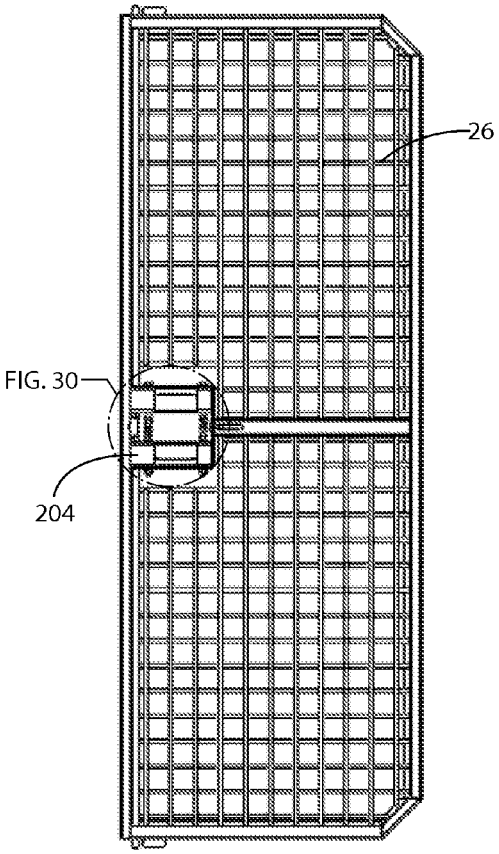
FIG. 29 is a rear view of the second door.
Figure 28:
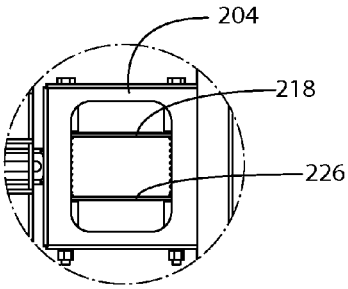
FIG. 28 is a detail view of the door handle from FIG. 27.
Figure 30:
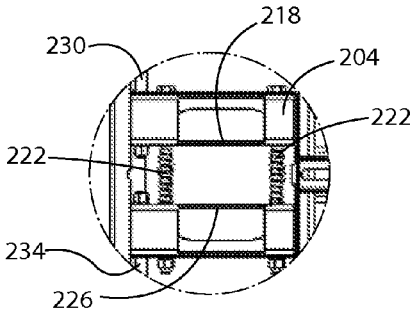
FIG. 30 is a detail view of the door handle form FIG. 29.

FIG. 27 is a front view of the second door 26. FIG. 28 is a detail view of the second door handle 204 from FIG. 27. FIG. 29 is a rear view of the second door 26, and FIG. 30 is a detail view of the second door handle 204 from FIG. 29. In FIG. 30, one can see clearly that there may be two springs 222 in communication with the upper spring loaded sliding member 218 and the lower spring loaded sliding member 226.

This invention has many advantages. The disclosed locker can handle heavy loads, up to about 5000 lbs. The disclosed lockers may be stacked. The lockers have sling loading capability. The lockers have strapping points to strap goods inside the lockers, and to strap the lockers down to the ground or the floor of the containers they are being shipped in. The lockers have forklift pockets in the front, back, and both sides. The locker is strong enough to be positioned on uneven ground without the doors being skewed noticeably. This is accomplished through the angled door corners which enable diagonal strengthening material in each corner around the door, and diagonal strengthening makes the cage more rigid, and without it you would need wider or heavier beams around the door. The lockers have a locking mechanism located inside the door. Thus, there are no parts of the locking mechanism that extends out past the volume defined by the locker, thus limiting the ability of the locker to be damaged by forklifts, shifting, transport, etc. The locking mechanism locks both the top and bottom part of the door.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A cargo transportation locker, the locker comprising:

a floor;

a first corner post in communication with the floor;

a second corner post in communication with the floor;

a third corner post in communication with the floor;

a fourth corner post in communication with the floor;

a first door in rotatable communication with the first corner post, the first door comprising:

a first door handle; the first door handle comprising:

a slideable member configured to slide from the first door to a second door, and when slid into the second door, the first and second doors are locked in a closed orientation;

a first slideable member hole, located in the slideable member, and when first slideable member hole is padlocked, the first and second doors are locked in a closed orientation;

a second slideable member hole, located in the slideable member, and when second slideable member hole is padlocked, the slideable member does not restrict the second door from opening and closing;

the second door in rotatable communication with the second corner post; the second door comprising:

a second door handle, the second door handle comprising:

an upper spring loaded sliding member;

at least one spring in communication with the upper spring loaded sliding member;

a lower spring loaded sliding member in communication with the at least one spring;

an upper locking rod in communication with the upper spring loaded member;

a lower locking rod in communication with the lower spring loaded member;

a first top support member in communication with the first corner post and the second corner post, the first top support member having a upper rod hole in its underside;

a first floor support member located beneath the floor and in communication with the first corner post and second corner post, the first floor support member having a lower rod hole in its upper side; and wherein when the upper spring loaded sliding member and lower spring loaded sliding member are fully spread apart, the upper locking rod extends through the upper rod hole, and the lower locking rod extends through the lower rod hole thereby locking the second door to the locker, and when the upper spring loaded sliding member and lower spring loaded sliding member are squeezed together, the upper locking rod retracts from the upper rod hole and the lower locking rod retracts from the lower rod hole, thereby unlocking the second door from the locker.

2. A cargo transportation locker, the locker comprising:

a floor;

a first corner post in communication with the floor;

a second corner post in communication with the floor;

a third corner post in communication with the floor;

a fourth corner post in communication with the floor;

a first door in rotatable communication with the first corner post, the first door comprising:

a first angled door member located in an upper corner of the first door adjacent the first post, wherein the first angled door member makes an angle with the top side of the first door of less than 90°, and makes an angle of less than 90° with the hinged side of the first door;

a second angled door member located in a lower corner of the first door adjacent the first post, wherein the first angled door member makes an angle with the bottom side of the first door of less than 90°, and makes an angle of less than 90° with the hinged side of the first door;

a second door in rotatable communication with the second corner post; the second door comprising:

a third angled door member located in an upper corner of the second door adjacent the second post, wherein the third angled door member makes an angle with the top side of the second door of less than 90°, and makes an angle of less than 90° with the hinged side of the second door;

a fourth angled door member located in a lower corner of the second door adjacent the second post, wherein the fourth angled door member makes an angle with the bottom side of the second door of less than 90°, and makes an angle of less than 90° with the hinged side of the second door;

a first top support member in communication with the first corner post and the second corner post, the first top support member having a upper rod hole in its underside;

a first floor support member located beneath the floor and in communication with the first corner post and second corner post, the first floor support member having a lower rod hole in its upper side;

wherein the second door further comprises:

a second door handle, the second door handle comprising:

an upper spring loaded sliding member;

at least one spring in communication with the upper spring loaded sliding member;

a lower spring loaded sliding member in communication with the at least one spring;

an upper locking rod in communication with the upper spring loaded member;

a lower locking rod in communication with the lower spring loaded member;

wherein when the upper spring loaded sliding member and lower spring loaded sliding member are fully spread apart, the upper locking rod extends through the upper rod hole, and the lower locking rod extends through the lower rod hole thereby locking the second door to the locker, and when the upper spring loaded sliding member and lower spring loaded sliding member are squeezed together, the upper locking rod retracts from the upper rod hole and the lower locking rod retracts from the lower rod hole, thereby unlocking the second door from the locker;

wherein the first door further comprises:

a first door handle, the first door handle comprising:

a slideable member configured to slide from the first door to the second door, and when slid into the second door, the first and second doors are locked in closed orientation;

a first slideable member hole, located in the slideable member, and when first slideable member hole is padlocked, the first and second doors are locked in a closed orientation;

a second slideable member hole, located in the slideable member, and when second slideable member hole is padlocked, the slideable member does not restrict the second door from opening and closing.

3. The cargo transportation locker of claim 2, further comprising:

a first top support member in communication with the first corner post and the second corner post;

a second top support member in communication with the third corner post and the fourth corner post;

a first corner bracket attached to the first corner post and the first top support member, the first corner bracket extending into an empty area provided by the first angled door member;

a second corner bracket attached to the second corner post and the first top support member, the second corner bracket extending into an empty area provided by the third angled door member;

a third corner bracket attached to the third corner post and the second top support member, a fourth corner bracket attached to the fourth corner post and the second top support member, and wherein the first, second, third, and fourth corner brackets provide rigidity and strength to the cargo transportation locker.

4. The cargo transportation locker of claim 2, further comprising:

a first floor support member located beneath the floor and in communication with the first corner post and second corner post, a first internal strapping member attached to the first corner post and to the first floor support member, the first internal strapping member located generally above the floor;

a second internal strapping member attached to the second corner post and to the first floor support member, the second internal strapping member located generally above the floor;

a third internal strapping member attached to the inner walls that comprise the third post, and the third strapping member located generally above the floor; and a fourth internal strapping member attached to the inner walls that comprise the fourth post, and the fourth strapping member located generally above the floor.

5. The cargo transportation locker of claim 2, further comprising:

a first floor support member located beneath the floor and in communication with the first corner post and second corner post, a second floor support member located beneath the floor and in communication with the third corner post and fourth corner post, a first bottom rail located beneath the first floor support and in communication with the first corner post and the second corner post;

a second bottom rail located beneath the first floor support and in communication with the third corner post and the fourth corner post;

a first external strapping member attached to the first floor support member and the first bottom rail, and located adjacent the first corner post;

a second external strapping member attached to the first floor support member and the first bottom rail, and located adjacent the second corner post;

a third external strapping member attached to the second floor support member and the second bottom rail, and located adjacent the third corner post; and a fourth external strapping member attached to the second floor support member and the second bottom rail, and located adjacent the fourth corner post.

6. The cargo transportation locker of claim 2, further comprising:

a first floor support member located beneath the floor and in communication with the first corner post and second corner post, a second floor support member located beneath the floor and in communication with the third corner post and fourth corner post, a first bottom rail located beneath the first floor support and in communication with the first corner post and the second corner post;

a second bottom rail located beneath the first floor support and in communication with the third corner post and the fourth corner post;

a first side member attached to the first corner post and fourth corner post;

a second side member attached to the second corner post and third corner post;

a third floor support member located beneath the floor and in communication with the first side member and second side member;

a first forklift guide attached to the first floor support member and first bottom rail, and located adjacent to the first corner post;

a second forklift guide attached to the first floor support member and first bottom rail, and located adjacent to the first forklift guide;

a third forklift guide attached to the first floor support member and first bottom rail, and located adjacent to the second corner post;

a fourth forklift guide attached to the third floor support member and generally located in the same vertical plane as the first forklift guide;

a fifth forklift guide attached to the third floor support member and generally located in the same vertical plane as the second forklift guide;

a sixth forklift guide attached to the third floor support member and generally located in the same vertical plane as the third forklift guide;

a third bottom rail attached to the fourth forklift guide, fifth forklift guide, and sixth forklift guide;

a seventh forklift guide attached to the second floor support member and second bottom rail, and located in the same vertical plane as the first forklift guide and fourth forklift guide;

an eighth forklift guide attached to the second floor support member and second bottom rail, and located in the same vertical plane as the second forklift guide and fifth forklift guide;

a ninth forklift guide attached to the second floor support member and second bottom rail, and located in the same vertical plane as the third forklift guide and sixth forklift guide; and wherein the nine forklift guides are orientated such that they form two fork lift openings in the front bottom of the locker, rear bottom of the locker, first side bottom of the locker, and second side bottom of the locker.

7. The cargo transportation locker of claim 2, further comprising:

a first floor support member located beneath the floor and in communication with the first corner post and second corner post, a second floor support member located beneath the floor and in communication with the third corner post and fourth corner post, a first angled member attached to the first corner post, the first angled member comprising a vertical portion directly attached to the first corner post, and an angled portion located below the vertical portion, and extending at an angle from the vertical portion towards a volume located underneath the locker;

a second angled member attached to the second corner post, the second angled member comprising a vertical portion directly attached to the second corner post, and an angled portion located below the vertical portion, and extending at an angle from the vertical portion towards a volume located underneath the locker;

a third angled member attached to the third corner post, the third angled member comprising a vertical portion directly attached to the third corner post, and an angled portion located below the vertical portion, and extending at an angle from the vertical portion towards a volume located underneath the locker;

a fourth angled member attached to the fourth corner post, the fourth angled member comprising a vertical portion directly attached to the fourth corner post, and an angled portion located below the vertical portion, and extending at an angle from the vertical portion towards a volume located underneath the locker;

a first bottom rail located beneath the first floor support and attached to the first angled member and the second angled member;

a second bottom rail located beneath the first floor support and attached to the third angled member and the fourth angled member; and wherein when a top locker is stacked on a bottom locker, the angled members will generally self-center the top locker into the bottom locker.

8. The cargo transportation locker of claim 2, further comprising:

a first hinge attaching the first door to the first corner post;

a second hinge attaching the first door to the first corner post;

a third hinge attaching the second door to the second corner post;

a fourth hinge attaching the second door to the second corner post;

a first hinge protector extending generally orthogonally from the first corner post, the first hinge protector comprising:

a main wall located generally parallel and adjacent to the first hinge;

a first sidewall extending perpendicularly from the main wall and towards the first hinge, and located generally above the first hinge;

a second sidewall extending perpendicularly from the main wall and towards the first hinge, and located generally below the first hinge;

a second hinge protector extending generally orthogonally from the first corner post, the second hinge protector comprising:

a main wall located generally parallel and adjacent to the second hinge;

a first sidewall extending perpendicularly from the main wall and towards the second hinge, and located generally above the second hinge;

a second sidewall extending perpendicularly from the main wall and towards the second hinge, and located generally below the second hinge;

a third hinge protector extending generally orthogonally from the second corner post, the third hinge protector comprising:

a main wall located generally parallel and adjacent to the third hinge;

a first sidewall extending perpendicularly from the main wall and towards the third hinge, and located generally above the third hinge;

a second sidewall extending perpendicularly from the main wall and towards the third hinge, and located generally below the third hinge;

a fourth hinge protector extending generally orthogonally from the second corner post, the fourth hinge protector comprising:

a main wall located generally parallel and adjacent to the fourth hinge;

a first sidewall extending perpendicularly from the main wall and towards the fourth hinge, and located generally above the fourth hinge; and a second sidewall extending perpendicularly from the main wall and towards the fourth hinge, and located generally below the fourth hinge.

* * * * *